US011779183B2

(12) United States Patent
Wang et al.

(10) Patent No.: US 11,779,183 B2
(45) Date of Patent: Oct. 10, 2023

(54) FLOOR SWEEPING ROBOT SYSTEM WITH AUTOMATIC DUST COLLECTION FUNCTION

(71) Applicant: Guangdong Lesheng Intelligent Technology Co., Ltd., Dongguan (CN)

(72) Inventors: Jun Wang, Hunan (CN); Xiaoning Wang, Inner Mongolia (CN)

(73) Assignee: Guangdong Lesheng Intelligent Technology Co., Ltd., Dongguan (CN)

( * ) Notice: Subject to any disclaimer, the term of this patent is extended or adjusted under 35 U.S.C. 154(b) by 763 days.

(21) Appl. No.: 16/923,105

(22) Filed: Jul. 8, 2020

(65) Prior Publication Data

US 2020/0367714 A1 Nov. 26, 2020

(51) Int. Cl.

| | |
|---|---|
| ***A47L 9/14*** | (2006.01) |
| ***A47L 11/40*** | (2006.01) |
| ***A47L 11/24*** | (2006.01) |
| ***A47L 9/28*** | (2006.01) |
| ***A47L 9/10*** | (2006.01) |

(52) U.S. Cl.

CPC ..... *A47L 11/4025* (2013.01); *A47L 9/102* (2013.01); *A47L 9/106* (2013.01); *A47L 9/149* (2013.01); *A47L 9/2842* (2013.01); *A47L 9/2847* (2013.01); *A47L 11/24* (2013.01); *A47L 11/4011* (2013.01); *A47L 11/4027* (2013.01); *A47L 11/4044* (2013.01); *A47L 11/4083* (2013.01); *A47L 2201/024* (2013.01); *A47L 2201/06* (2013.01)

(58) Field of Classification Search

CPC ..... A47L 11/4025; A47L 9/102; A47L 9/106; A47L 9/149; A47L 9/2842; A47L 9/2847; A47L 11/24; A47L 11/4011; A47L 11/4027; A47L 11/4044; A47L 11/4083; A47L 2201/024; A47L 2201/06; A47L 11/4016; A47L 11/4088

See application file for complete search history.

(56) References Cited

U.S. PATENT DOCUMENTS

| | | | | |
|---|---|---|---|---|
| 4,380,844 | A * | 4/1983 | Waldhauser | A47L 11/4075 15/349 |
| 10,369,644 | B2 * | 8/2019 | Suzuki | H05K 3/36 |
| 2017/0042400 | A1 * | 2/2017 | Lee | A47L 5/36 |
| 2020/0023511 | A1 * | 1/2020 | Lee | B25J 9/0084 |
| 2020/0146520 | A1 * | 5/2020 | Caspar | A47L 9/2894 |
| 2020/0345190 | A1 * | 11/2020 | Buehler | A47L 11/4083 |

(Continued)

FOREIGN PATENT DOCUMENTS

| | | | | |
|---|---|---|---|---|
| CN | 209346902 U | * | 9/2019 | |
| CN | 111134578 A | * | 5/2020 | |
| WO | WO-2020007377 A1 | * | 1/2020 | A47L 11/24 |

*Primary Examiner* — Dung H Bui

(74) *Attorney, Agent, or Firm* — Nitin Kaushik

(57) ABSTRACT

The present application provides a floor sweeping robot system with an automatic dust collection function, which sucks garbage in a water-dust integrated box and automatically treats garbage inside a floor sweeping robot, thereby solving problems for consumers. Accordingly, the frequency of cleaning the machine and recycling garbage is reduced, and the cleaning operation is performed at one time, so that the cleaning efficiency is improved greatly. The integrated design of the water-dust integrated box can greatly save the space, and is lower in production cost and more convenient for a user to clean.

9 Claims, 10 Drawing Sheets

(56) References Cited

U.S. PATENT DOCUMENTS

| | | | | |
|---|---|---|---|---|
| 2020/0367714 | A1* | 11/2020 | Wang | A47L 11/4011 |
| 2021/0100417 | A1* | 4/2021 | Tauber | G08C 17/02 |
| 2021/0330157 | A1* | 10/2021 | Conrad | A47L 9/248 |
| 2022/0354327 | A1* | 11/2022 | Kim | A47L 9/2847 |

* cited by examiner

FLOOR SWEEPING ROBOT SYSTEM WITH AUTOMATIC DUST COLLECTION FUNCTION

BACKGROUND OF THE INVENTION

The present invention relates to the technical field of cleaning devices, and in particular to a floor sweeping robot system with an automatic dust collection function.

With the continuous improvement of people's living standards, people's requirements for the quality of life are getting higher and higher. However, since the pressure of social population is increasing, it is expected to have more household products convenient for life to save people's energy and improve their happiness. To meet people's requirements, household floor sweeping robots have appeared.

In the prior art, a cleaning robot is integrated with a dust collection box which will collect garbage on an outer wall of a roller to realize automatic cleaning of the roller. When the dust collection box is filled with garbage, the garbage in the dust collection box needs to be emptied manually. However, since a user usually starts the cleaning robot when the user goes out, when the garbage box is fulfilled with garbage, the cleaning robot will stop operating until the user comes back and deals with the problem. Therefore, the cleaning efficiency is greatly affected. Further, although the cleaning robot in the prior art has functions of sweeping and mopping the floor, the water tank and the dust collection box in the cleaning robot in the prior art are arranged separately. Therefore, two boxes, i.e., a water tank and a dust collection box, need to be arranged in a same machine. As a result, the occupied space is large, the production cost is high, and it is relatively troublesome for cleaning. Moreover, the cleaning robot in the prior art mop the floor by freely seeping water, so the water tank will leak water when it is unmoved, the amount of water during mopping the floor is uncontrollable, and it is unable to detect whether there is water in the water tank. Therefore, the efficiency and effect of mopping the floor are undesirable.

BRIEF SUMMARY OF THE INVENTION

To solve the above problems, the present invention provides a floor sweeping robot system with an automatic dust collection function, which sucks garbage in a water-dust integrated box, and thus can automatically treat garbage inside a floor sweeping robot and solve problems for consumers. Accordingly, the frequency of cleaning the machine and recycling garbage is reduced, and the cleaning operation is performed at one time, so that the cleaning efficiency is improved greatly. The integrated design of the water-dust integrated box can greatly save the space, and is simple in manufacturing, lower in production cost and more convenient for a user to clean both a clean water chamber and a dust collection chamber.

For this purpose, the present invention employs the following technical solutions. A floor sweeping robot system with an automatic dust collection function is provided, including a dust collection device and a floor sweeping robot, wherein a first control mainboard and a water-dust integrated box are arranged in the floor sweeping robot; a dust collection chamber for collecting dust and a clean water chamber for storing clean water are arranged in the water-dust integrated box, and the dust collection chamber is independent of the clean water chamber; a dust collection port communicated with the dust collection chamber and a plurality of alignment elastic sheets electrically connected to the first control mainboard are arranged on a side face of the water-dust integrated box, and an air inlet communicated with the dust collection chamber is formed in an outer rear surface of the water-dust integrated box; an opening communicated with the dust collection chamber is formed at a top end of the water-dust integrated box, and a filter assembly is covered on the opening; an air outlet aligned with the filter assembly is formed on the outer rear surface of the water-dust integrated box; a water pump, a water suction pipe, a water outlet pipe, a one-way valve and a delivery pipe are arranged in the clean water chamber; two detection elastic sheets electrically connected to the first control mainboard are arranged on a surface of the one-way valve; a tail end of the water suction pipe is arranged on the bottom of the clean water chamber and communicated with an input end of the water pump, an output end of the water pump is communicated with an input end of the one-way valve, and an output end of the one-way valve is communicated with the water outlet pipe through the delivery pipe; and, the other end of the water outlet pipe extends outside the clean water chamber and is communicated with a floor mopping assembly located on the bottom of the water-dust integrated box; and the dust collection device includes a dust collection shell, a garbage recycling assembly, a power supply assembly and a second control mainboard; the garbage recycling assembly, the power supply assembly and the second control mainboard are all arranged in the dust collection shell; trigger elastic sheets that are electrically connected to the second control mainboard and provided in a number corresponding to the number of the alignment elastic sheets are arranged on a surface of the dust collection shell; a dust collection cavity for accommodating dust garbage is further arranged in the dust collection shell; the garbage recycling assembly includes a negative pressure device that is communicated with the dust collection cavity and generates a negative pressure within the dust collection cavity, and a communication assembly that is communicated with the dust collection cavity; the power supply assembly is electrically connected to the negative pressure device and the second control mainboard, respectively, and the second control mainboard is electrically connected to the negative pressure device; the communication assembly includes a first conduit, a silicone passage, a second conduit and a rubber suction port that are communicated successively; the first conduit is communicated with the dust collection cavity, the rubber suction port extends outside the dust collection device, and the silicone passage can be compressively deformed in its axial direction; and, the trigger elastic sheets come into contact with the corresponding alignment elastic sheets of the floor sweeping robot, and the rubber suction port of the dust collection device is fitted at the dust collection port of the floor sweeping robot.

Further, the water outlet pipe is of a T-shaped structure; the water output pipe includes a vertical pipe in a vertical direction and a horizontal pipe in a horizontal direction; one end of the vertical pipe is communicated with the delivery pipe, while the other end of the vertical pipe is communicated with the horizontal pipe; and, a plurality of water outlet nozzles extending outside the clean water chamber are arranged on the bottom of the horizontal pipe.

Further, a water feeding hole communicated with the clean water chamber is formed at an upper end of the water-dust integrated box, a seal cover is mounted at the water feeding hole, and a ventilation slot is arranged on the seal cover.

Further, the power supply module includes a power supply control board, an adapter and a wireless communication module; an output end of the adapter is connected to an input end of the power supply control board; an output end of the power supply control board is connected to the second control mainboard and an input end of the negative pressure device, respectively; and, the wireless communication module is in bidirectional communication connection with the second control mainboard.

Further, the negative pressure device includes an air extraction fan communicated with the dust collection cavity; an output end of the second control mainboard is connected to an input end of the air extraction fan; an air inlet end of the air extraction fan is located on the bottom of the dust collection cavity and communicated with the dust collection cavity; and, a filter screen is arranged at the air inlet end of the air extraction fan.

Further, the floor sweeping robot further includes a first fixed shaft, a first return torsion spring and a first garbage baffle; the first garbage baffle is movably mounted at the dust collection port of the water-dust integrated box through the first fixed shaft; and, the first return torsion spring is sheathed on the first fixed shaft and enables the first garbage baffle to rotate relatively to open or close the dust collection port.

Further, a second fixed shaft, a second return torsion spring and a second garbage baffle are further mounted at the air inlet; the second garbage baffle is movably mounted at the air inlet through the second fixed shaft; and, the second return torsion spring is sheathed on the second fixed shaft and enables the second garbage baffle to rotate relatively to open or close the air inlet.

Further, an alarm is further arranged in the dust collection shell; a full garbage detection device is arranged above the dust collection cavity; and, an output end of the full garbage detection device is electrically connected to the input end of the second control mainboard, and the output end of the second control mainboard is connected to an input end of the alarm.

Further, the communication assembly further includes a fixed bracket and a reset spring; the first conduit is fixed on an inner bottom wall of the dust collection shell through the fixed bracket, and first fixed bumps are arranged on two sides of the fixed bracket; second fixed bumps are further arranged on outer sidewalls of two sides of the rubber suction port; and, one end of the reset spring is sheathed on the first fixed bump, while the other end of the reset spring is sheathed on the second fixed bump on the same side.

Further, the rubber suction port is of a funnel-shaped structure having an aperture that gradually decreases in a direction away from the dust collection port.

The present invention has the following beneficial effects.

1. When the dust garbage in the water-dust integrated box of the floor sweeping robot is full, the floor sweeping robot automatically returns to the dust collection device, and the dust collection port of the floor sweeping robot moves towards the rubber suction port of the dust collection device. When the dust collection port of the floor sweeping robot is preliminarily aligned and fitted with the rubber suction port, the floor sweeping robot continues moving forward to compress the rubber passage so as to realize a buffer effect, so that closer fitting of the rubber suction port with the dust collection port can be ensured. Moreover, the continuous forward movement of the floor sweeping robot makes the alignment elastic sheets of the floor sweeping robot separately contact with the two trigger elastic sheets on the surface of the dust collection device to form an electrical circuit. Thus, the first control mainboard will control the floor sweeping robot to stop operating, and the second control mainboard inside the dust collection device will issue an instruction and control the negative pressure device to activate to suck the garbage in the dust collection box in the water-dust integrated box. Therefore, the garbage inside the floor sweeping robot can be automatically treated, and consumers' problems are solved. Accordingly, the frequency of cleaning the machine and recycling garbage is reduced, and the cleaning operation is performed at one time, so that the cleaning efficiency is improved greatly.

2. In the present application, the water-dust integrated box integrates the dust collection chamber for collecting dust with the clean water chamber for storing clean water. Thus, both the basic function of collecting dust and the function of supplying water and mopping the floor can be realized. Moreover, the integrated design can greatly save the space, and is simple in manufacturing, lower in production cost and more convenient for a user to clean both the clean water chamber and the dust collection chamber.

3. Meanwhile, during the operation of the water pump, water is sucked from the clean water chamber by the water suction pipe and then sprayed out for mopping the floor through the water pump, the one-way valve, the delivery pipe and the water outlet pipe. When water passes through the one-way valve, the two detection elastic sheets and the first control mainboard form a circuit to generate current, and the first control mainboard will receive a current signal. When no water passes through the one-way valve, the detection elastic sheets and the first control mainboard will not form a circuit, and the first control mainboard does not receive the current signal, so that a rear-mounted alarm sends an alarm signal to remind the user that there is no water in the water tank. Such design can ensure that the floor sweeping robot will not leak water when it is unmoved. Moreover, the water pump can be controlled by a program set by the first control mainboard, so that the amount of water during mopping the floor can be controlled, and the water outlet amount can be controlled accurately.

Figure 1:
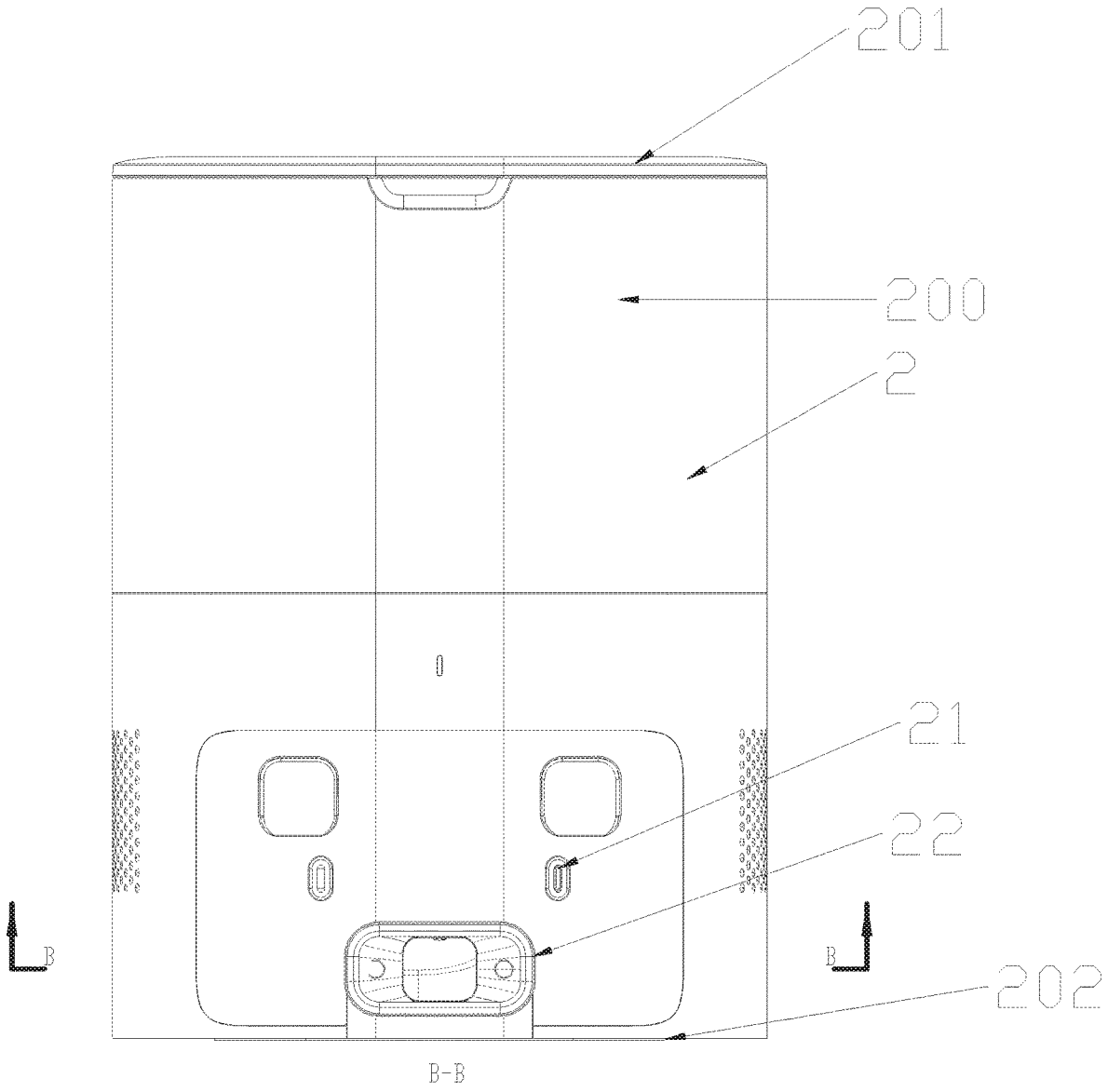
FIG. 1 is a schematic perspective view of a dust collection device according to the present invention.
Figure 2:
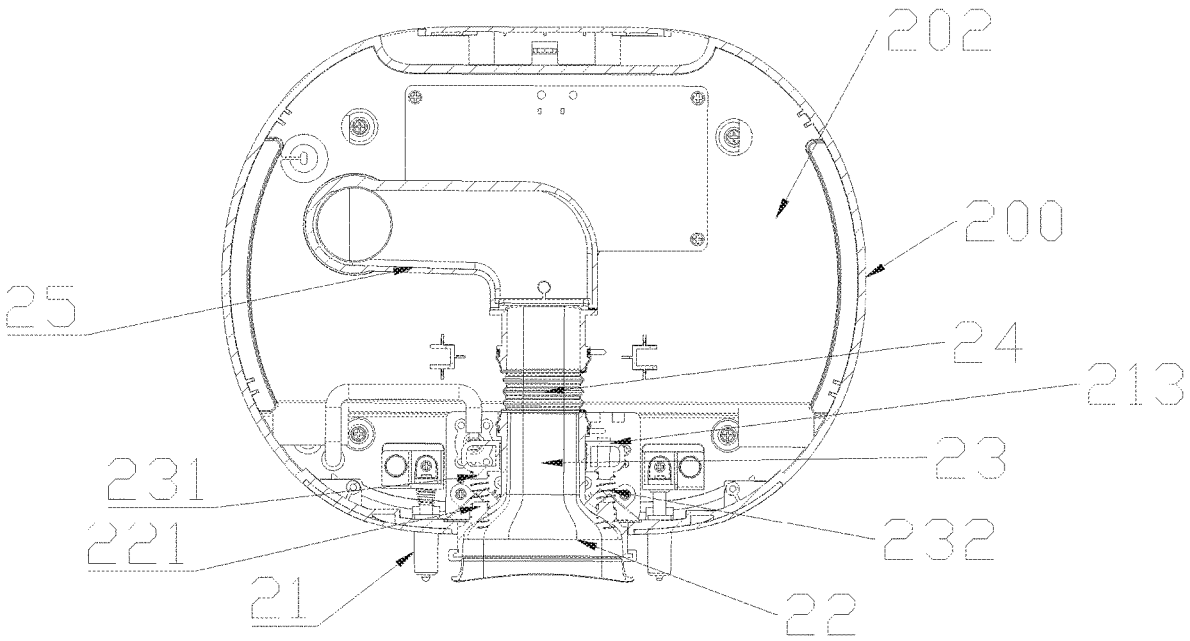
FIG. 2 is a sectional view along a sectional line B-B in FIG. 1.
Figure 3:
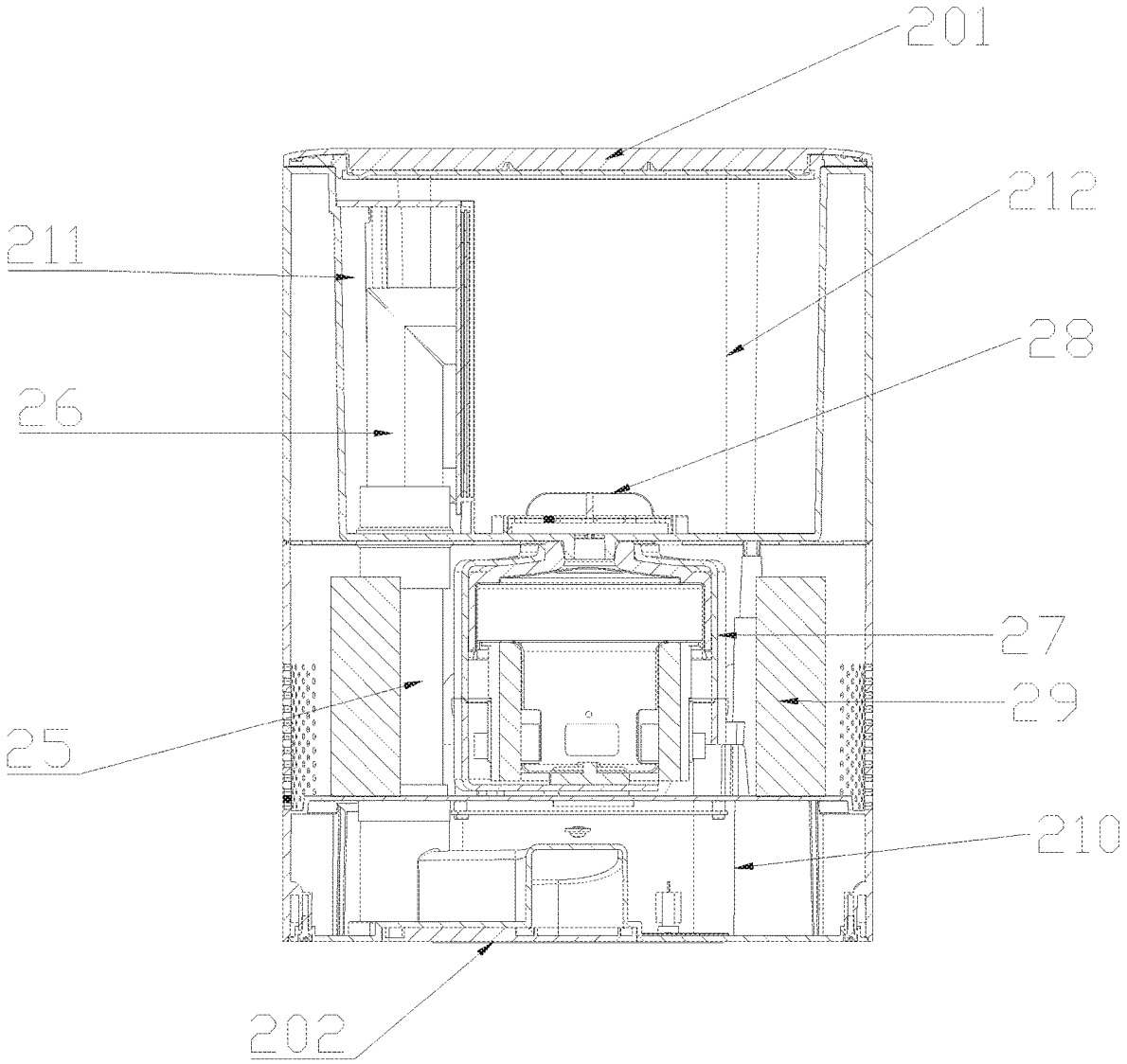
FIG. 3 is a schematic longitudinal sectional view of the dust collection device according to the present invention.
Figure 4:
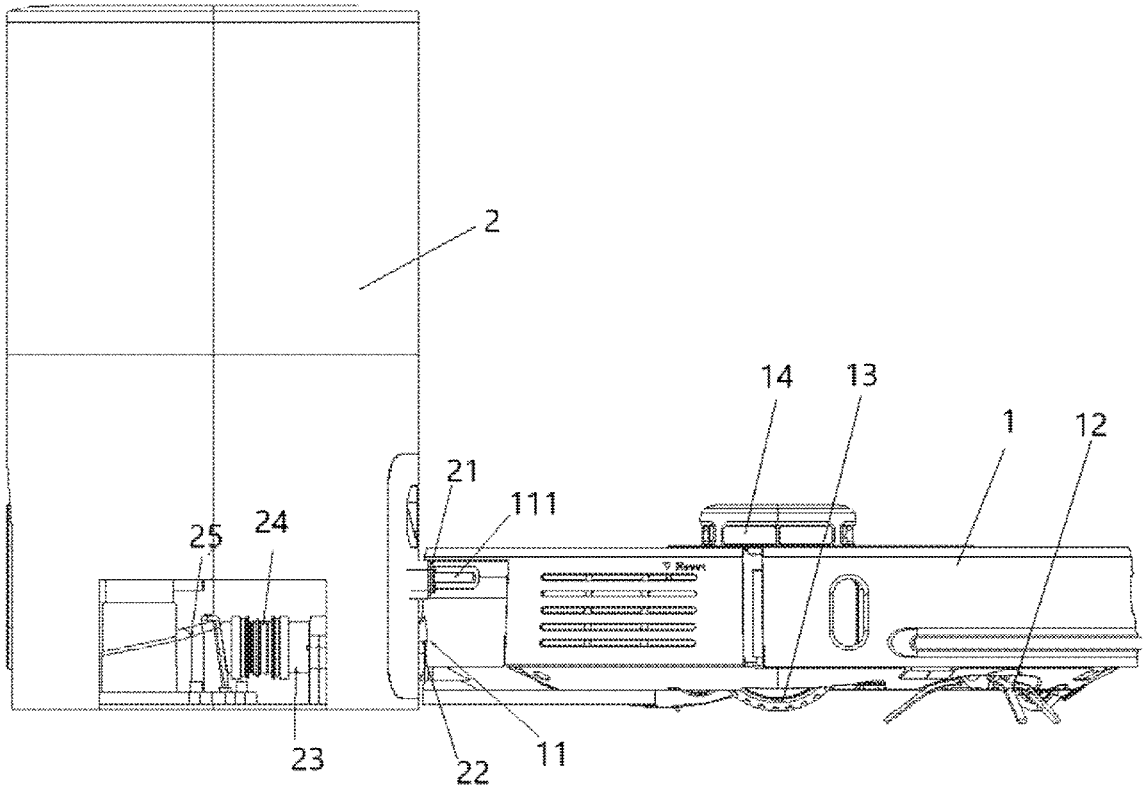
FIG. 4 is a schematic structural view of the cooperation of a floor sweeping robot and the dust collection device according to the present invention.
Figure 5:
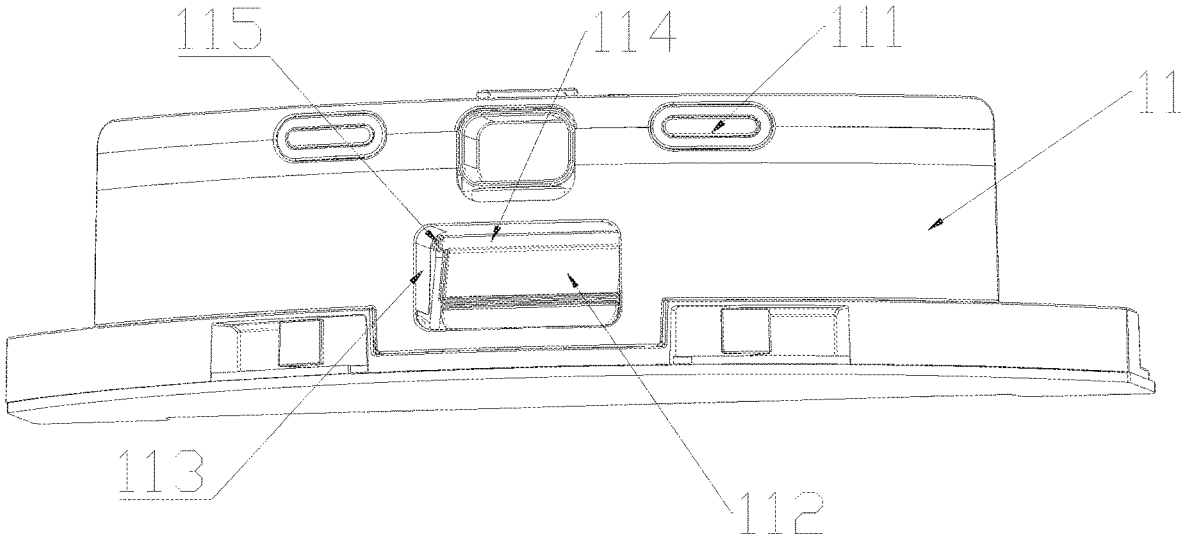
FIG. 5 is a schematic structural view of a water-dust integrated box according to the present invention.
Figure 6:
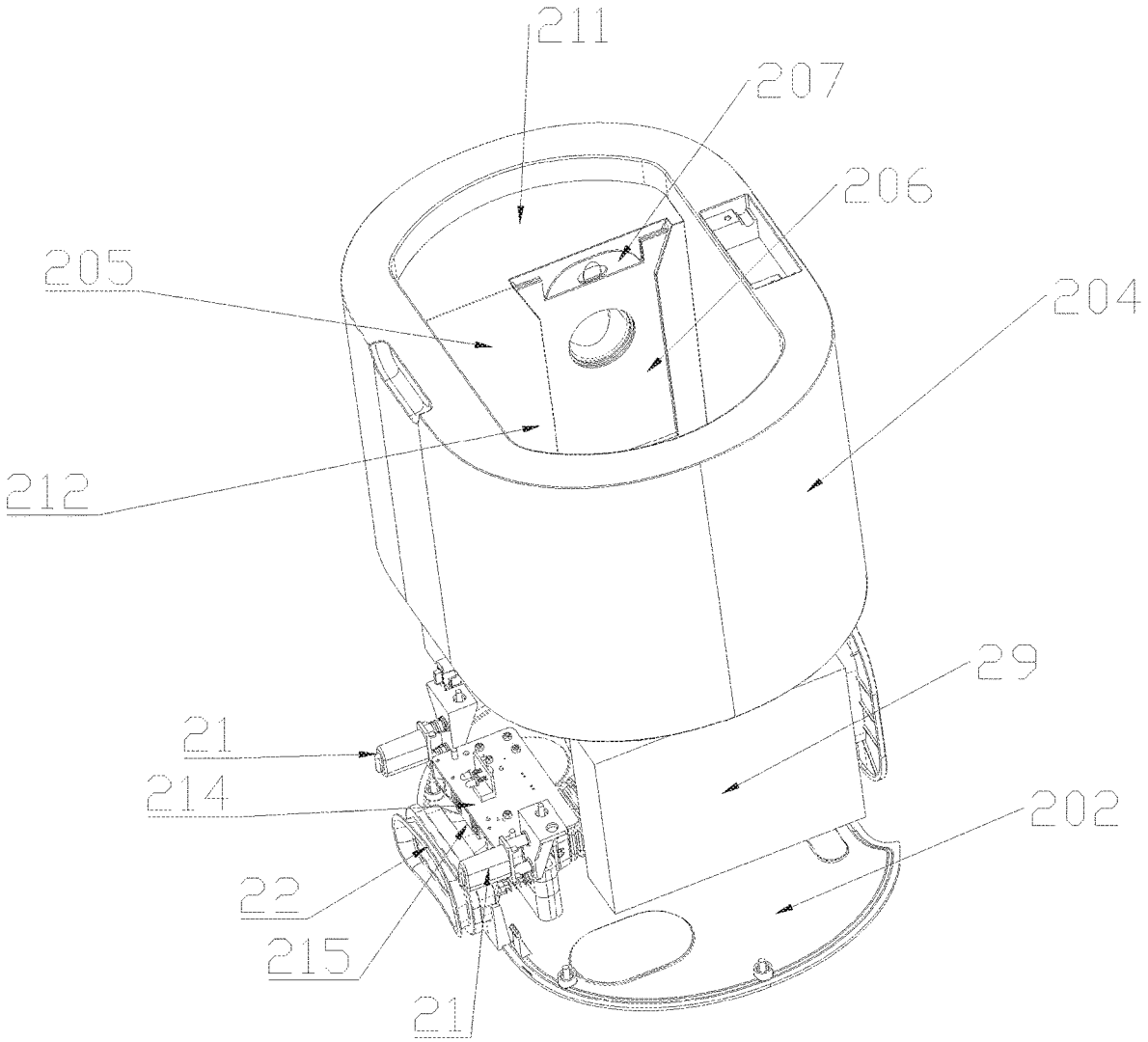
FIG. 6 is a schematic structural view of the dust collection device according to the present invention with a dust collection outer shell and a dust collection upper cover omitted.

in which:

1: floor sweeping robot; 11: water-dust integrated box; 111: alignment elastic sheet; 112: first garbage baffle; 113: dust collection port; 114: first fixed shaft; 115: first return torsion spring; 116: water tank cover; 117: seal cover; 1171: ventilation slot; 118: garbage clamshell; 1001: dust collection chamber; 1002: second garbage baffle; 1003: air inlet; 1004: air outlet; 1005: filter layer; 120: clean water chamber; 1201: water suction pipe; 1202: water pump; 1203: one-way valve; 1204: detection elastic sheet; 1205: water outlet nozzle; 1206: vertical pipe; 1207: horizontal pipe; 1208: delivery pipe; 12: side electric hairbrush assembly; 13: driving wheel assembly; 14: infrared detection assembly; 15: intermediate sweeping assembly; 16: universal wheel; 2: dust collection device; 200: dust collection outer shell; 201: dust collection upper cover; 202: dust collection soleplate; 204: dust collection inner shell; 205: vertical partition plate; 206: insertion plate; 207: dust bag; 213: fixed bracket; 231: first fixed bump; 232: reset spring; 21: trigger elastic sheet; 22: rubber suction port; 221: second fixed bump; 23: second conduit; 24: silicone passage; 25: first conduit; 26: communication conduit; 27: air extraction fan; 28: filter screen; 29: sound absorbing cotton; 210: modular cavity; 211: communication cavity; 212: dust collection cavity; 214: power supply control board; and, 215: second control mainboard.

DETAILED DESCRIPTION OF THE INVENTION

With reference to FIGS. 1-12, the present invention relates to a floor sweeping robot 1 system with an automatic dust collection function, including a dust collection device 2 and a floor sweeping robot 1. A first control mainboard and a water-dust integrated box 11 are arranged in the floor sweeping robot 1. A dust collection chamber 1001 for collecting dust and a clean water chamber 120 for storing clean water are arranged in the water-dust integrated box 11, and the dust collection chamber 1001 is independent of the clean water chamber 120. A dust collection port 113 communicated with the dust collection chamber 1001 and a plurality of alignment elastic sheets 111 electrically connected to the first control mainboard are arranged on a side face of the water-dust integrated box 11, and an air inlet 1003 communicated with the dust collection chamber 1001 is formed on an outer rear surface of the water-dust integrated box 11. An opening communicated with the dust collection chamber 1001 is formed at a top end of the water-dust integrated box 11, and a filter assembly is covered on the opening. An air outlet 1004 aligned with the filter assembly is formed on the outer rear surface of the water-dust integrated box 11. A water pump 1202, a water suction pipe 1201, a water outlet pipe, a one-way valve 1203 and a delivery pipe 1208 are arranged in the clean water chamber 120. Two detection elastic sheets 1204 electrically connected to the first control mainboard are arranged on a surface of the one-way valve 1203. A tail end of the water suction pipe 1201 is arranged on the bottom of the clean water chamber 120 and communicated with an input end of the water pump 1202, an output end of the water pump 1202 is communicated with an input end of the one-way valve 1203, and an output end of the one-way valve 1203 is communicated with the water outlet pipe through the delivery pipe 1208. The other end of the water outlet pipe extends outside the clean water chamber 120 and is communicated with a floor mopping assembly located on the bottom of the water-dust integrated box 11.

The dust collection device 2 includes a dust collection shell, a garbage recycling assembly, a power supply assembly and a second control mainboard 215. The garbage recycling assembly, the power supply assembly and the second control mainboard 215 are all arranged in the dust collection shell. Trigger elastic sheets 21 that are electrically connected to the second control mainboard 215 and provided in a number corresponding to the number of the alignment elastic sheets 111 are arranged on a surface of the dust collection shell. A dust collection cavity 212 for accommodating dust garbage is further arranged in the dust collection shell. The garbage recycling assembly includes a negative pressure device that is communicated with the dust collection cavity 212 and generates a negative pressure within the dust collection cavity 212, and a communication assembly that is communicated with the dust collection cavity 212. The power supply assembly is electrically connected to the negative pressure device and the second control mainboard 215, respectively, and the second control mainboard 215 is electrically connected to the negative pressure device. The communication assembly includes a first conduit 25, a silicone passage 24, a second conduit 23 and a rubber suction port 22 that are communicated successively. The first conduit 25 is communicated with the dust collection cavity 212, the rubber suction port 22 extends outside the dust collection device 2, and the silicone passage 24 can be compressively deformed in its axial direction. The trigger elastic sheets 21 come into contact with the corresponding alignment elastic sheets 111 of the floor sweeping robot 1, and the rubber suction port 22 of the dust collection device 2 is fitted at the dust collection port 113 of the floor sweeping robot 1.

When the water-dust integrated box 11 of the floor sweeping robot 1 is fulfilled with dust garbage, the floor sweeping robot 1 automatically returns to the dust collection device 2, and the dust collection port 113 of the floor sweeping robot 1 moves towards the rubber suction port 22 of the dust collection device 2. When the dust collection port 113 of the floor sweeping robot 1 is preliminarily aligned and fitted with the rubber suction port 22, the floor sweeping robot 1 continues moving forward to compress the rubber passage so as to realize a buffer effect, so that closer fitting of the rubber suction port 22 with the dust collection port 113 can be ensured. Moreover, the continuous forward movement of the floor sweeping robot 1 makes the alignment elastic sheets 111 of the floor sweeping robot 1 separately contact with the two trigger elastic sheets 21 on the surface of the dust collection device 2 to form an electrical circuit. Thus, the first control mainboard will control the floor sweeping robot 1 to stop operating, and the second control mainboard 215 inside the dust collection device 2 will issue an instruction and control the negative pressure device to activate to suck the garbage in the dust collection box in the water-dust integrated box 11. Therefore, the garbage inside the floor sweeping robot 1 can be automatically treated, and consumers' problems are solved. Accordingly, the frequency of cleaning the machine and recycling garbage is reduced, and the cleaning operation is performed at one time, so that the cleaning efficiency is improved greatly.

In the present application, the water-dust integrated box 11 integrates the dust collection chamber 1001 for collecting dust with the clean water chamber 120 for storing clean water. Thus, both the basic function of collecting dust and the function of supplying water and mopping the floor can be realized. Moreover, the integrated design can greatly save the space, and is simple in manufacturing, lower in production cost and more convenient for a user to clean both the clean water chamber 120 and the dust collection chamber 1001.

Meanwhile, during the operation of the water pump 1202, water is sucked from the clean water chamber 120 by the water suction pipe 1201 and then sprayed out for mopping the floor through the water pump 1202, the one-way valve 1203, the delivery pipe 1208 and the water outlet pipe. When water passes through the one-way valve 1203, the two detection elastic sheets 1204 and the first control mainboard form a circuit to generate current, and the first control mainboard will receive a current signal. When no water passes through the one-way valve 1203, the detection elastic sheets 1204 and the first control mainboard will not form a circuit, and the first control mainboard does not receive the current signal, so that a rear-mounted alarm sends an alarm signal to remind the user that there is no water in the water tank. Such design can ensure that the floor sweeping robot 1 will not leak water when it is unmoved. Moreover, the water pump 1202 can be controlled by a program set by the first control mainboard, so that the amount of water during mopping the floor can be controlled, and the water outlet amount can be controlled accurately.

The operating principle of the present application will be specifically described below, including the following steps.

1. The floor sweeping robot 1 scans by an infrared detection assembly 14, and accurately determines the position of the dust collection device 2 by a laser radar. When the floor sweeping robot moves to a position 300 mm away from the dust collector, the floor sweeping robot turns by 180°.

2. After turning by 180°, the floor sweeping robot 1 moves to the dust collection device 2, and the dust collection port 113 of the floor sweeping robot 1 moves towards the rubber suction port 22 of the dust collection device 2. When the dust collection port 113 is preliminarily sealed and fitted with the rubber suction port 22, the floor sweeping robot 1 continues moving forward to compress the rubber passage, and the alignment elastic sheets 111 of the floor sweeping robot 1 come into contact with the corresponding trigger elastic sheets 21 on the surface of the dust collection device 2 to form a communication circuit. Thus, the first control main board will control the floor sweeping robot 1 to stop operating, and the second control mainboard 215 inside the dust collection device 2 will issue an instruction and control the negative pressure device to activate to suck the garbage in the water-dust integrated box 11. Therefore, the garbage inside the floor sweeping robot 1 can be automatically treated.

When the water-dust integrated box 11 of the floor sweeping robot 1 is fulfilled with dust garbage, the floor sweeping robot 1 automatically returns to the dust collection device 2, and the dust collection port 113 of the floor sweeping robot 1 moves towards the rubber suction port 22 of the dust collection device 2. When the dust collection port 113 of the floor sweeping robot 1 is preliminarily aligned and fitted with the rubber suction port 22, the floor sweeping robot 1 continues moving forward to compress the rubber passage so as to realize a buffer effect, meanwhile a closer fitting of the rubber suction port 22 with the dust collection port 113 can be ensured. Moreover, the continuous forward movement of the floor sweeping robot 1 makes the alignment elastic sheets 111 of the floor sweeping robot 1 separately contact with the two trigger elastic sheets 21 on the surface of the dust collection device 2 to form an electrical circuit. Thus, the first control mainboard will control the floor sweeping robot 1 to stop operating, and the second control mainboard 215 inside the dust collection device 2 will issue an instruction and control the negative pressure device to activate to suck the garbage in the dust collection box in the water-dust integrated box 11. Therefore, the garbage inside the floor sweeping robot 1 can be automatically treated, and consumers' problems are solved. Accordingly, the frequency of cleaning the machine and recycling garbage is reduced, and the cleaning operation is performed at one time, so that the cleaning efficiency is improved greatly.

Further, the water outlet pipe is of a T-shaped structure; the water output pipe includes a vertical pipe 1206 in a vertical direction and a horizontal pipe 1207 in a horizontal direction; one end of the vertical pipe 1206 is communicated with the delivery pipe 1208, while the other end of the vertical pipe is communicated with the horizontal pipe 1207; and, a plurality of water outlet nozzles 1205 extending outside the clean water chamber 120 are arranged on the bottom of the horizontal pipe 1207. In this specific embodiment, a plurality of water outlet nozzles 1205 extending outside the clean water chamber 120 are provided. The water outlet nozzles 1205 serve and supply water to the floor mopping assembly.

Further, an opening is formed at a position, corresponding to the clean water chamber 120, on the top of the water-dust integrated box 11, and a water tank cover 116 is detachably connected at the opening by a bolt. A water feeding hole communicated with the clean water chamber 120 is formed in a surface of the water tank cover 116, a seal cover 117 is mounted at the water feeding hole, and a ventilation slot 1171 is arranged on the seal cover 117. A user can open the seal cover 117 and feed water into the clean water chamber 120 through the water feeding water. Moreover, by arranging the ventilation slot 1171 on the seal cover 117, a consistent air pressure can be maintained inside and outside the water tank without water leakage. Since the water tank cover 116 is detachably arranged at the opening, even if foreign matters enter the clean water chamber 120, the foreign matters can be cleaned by detaching the water tank cover 116.

Meanwhile, in the present application, the filter assembly at the top end of the water-dust integrated box 11 specifically includes a filter layer 1005 and a garbage clamshell 118. The garbage clamshell 118 is movably mounted at the opening by a rotating shaft, the filter layer 1005 is detachably arranged on the bottom of the garbage clamshell 118, and an air outlet 1004 is formed in a rear surface of the garbage clamshell 118. Normally, the floor sweeping robot 1 can clean garbage by the dust collection device 2. However, in case of a power failure, the user can manually disassemble the whole dust-water integrated box 11, and then open the garbage clamshell 118 and empty the garbage, and the filter layer 1005 can be disassembled for cleaning.

Further, the power supply module includes a power supply control board 214, an adapter and a wireless communication module; an output end of the adapter is connected to an input end of the power supply control board 214; an output end of the power supply control board 214 is connected to the second control mainboard 215 and an input end of the negative pressure device, respectively; and, the wireless communication module is in bidirectional communication connection with the second control mainboard 215. When in user, one end of the adapter is connected to a commercial power supply, while the other end of the adapter is connected to the power supply control board 214, so that power can be supplied to various modules such as the power supply control board 214, the trigger elastic sheets 21, the negative pressure device and the second control mainboard 215. Moreover, in the present application, the system can be connected to an intelligent terminal of the user through the wireless communication module, so that the user can directly view the operation of the dust collection device 2.

Further, the negative pressure device includes an air extraction fan 27 communicated with the dust collection cavity 212; an output end of the second control mainboard 215 is connected to an input end of the air extraction fan 27; an air inlet end of the air extraction fan 27 is located on the bottom of the dust collection cavity 212 and communicated with the dust collection cavity 212; and, a filter screen 28 is arranged at the air inlet end of the air extraction fan 27.

If the air extraction fan 27 is directly used to extract air in the dust collection cavity 212, small-particle garbage inside the floor sweeping robot 1 will enter the air extraction fan 27, and the operation of the air extraction fan 27 will be affected after a long-term use. Therefore, in this specific embodiment, by arranging the filter screen 28 at the air inlet end of the air extraction fan 27, the small-particle garbage can be filtered prevented from entering the air extraction fan 27. Moreover, in the present application, the dust collection shell includes a dust collection upper cover 201, a dust collection soleplate 202, an annular dust collection outer shell 200 and a dust collection inner shell 204. The dust collection soleplate 202 is arranged at a lower end of the dust collection outer shell 200, and the dust collection upper cover is covered at an upper end of the dust collection outer shell 200. The dust collection upper cover 201, the dust collection soleplate 20 and the annular dust collection outer shell 200 enclose a modular cavity 200, the dust collection inner shell is arranged within the modular cavity 210, and a vertical partition plate 205 extending in a vertical direction is arranged in the dust collection inner shell. The dust collection inner shell is divided into a communication cavity 211 and a dust collection cavity 212 in a left-right direction by the vertical partition plate 205. The garbage recycling assembly, the power supply assembly and the second control mainboard 215 are arranged in the modular cavity 210. A communication conduit 26 is arranged within the communication cavity 211. One end of the communication conduit 26 extends outside the communication cavity 211 and is communicated with the first conduit 25, while the other end of the communication conduit is communicated with the dust collection cavity 212. Thus, the dust in the water-dust integrated box 11 of the floor sweeping robot 1 will enter the dust collection cavity 212 after successively passing through the dust collection port 113, the rubber suction port 22, the second conduit 23, the silicone passage 24, the first conduit 25 and the communication conduit 26, so as to realize dust collection. To facilitate the subsequent treatment of the dust, in the present application, a dust bag 207 for loading dust is provided. The dust bag 207 is air-permeable and can transfer large-particle dust. In the present application, a gap is further provided on the vertical partition plate 205 between the communication cavity 211 and the dust collection cavity 212, and an insertion plate 260 with an open pore is assembled with the dust bag 207. Specifically, the opening of the dust bag 207 is arranged on the open pore of the insertion plate 206, that is, the opening of the dust bag 207 is opened. Then, the insertion plate 206 is inserted into the gap, so that the opening of the dust bag 207 is aligned with the communication conduit 26 to collect dust. When the cleaning operation is required, the whole dust bag 207 can be taken out by pulling the insertion plate 206 out from gap, so it is more convenient and quicker. Moreover, a micro-switch connected to the second control mainboard 215 is arranged at the gap. The micro-switch will be triggered when the insertion plate 206 is inserted into the gap, so it is indicated that the dust bag 207 is mounted in place, and the second control mainboard 215 will lighten the corresponding indicator lamp. If the dust bag 207 is not mounted in place (the insertion plate 206 is not inserted into the gap or the insertion plate 206 is not completely inserted into the gap, the second control mainboard 215 will lighten the corresponding indicator lamp to remind the user.

Further, the floor sweeping robot 1 further includes a first fixed shaft 114, a first return torsion spring 115 and a first garbage baffle 112; the first garbage baffle 112 is movably mounted at the dust collection port 113 of the water-dust integrated box 11 through the first fixed shaft 114; and, the first return torsion spring 115 is sheathed on the first fixed shaft 114 and enables the first garbage baffle 112 to rotate relatively to open or close the dust collection port 113. Further, to prevent the dust inside the floor sweeping robot 1 from escaping from the dust collection port 113 during the normal operation of the floor sweeping robot 1, a first garbage baffle 12 is hinged to the dust collection port 113, and the first garbage baffle 12 can rotate relatively to open or close the dust collection port 113. When the dust collection device 2 sucks garbage inside the water-dust integrated box 11, the air extraction fan 27 generates a strong suction force to open the first garbage baffle 112, so that the air path can be communicated. During the normal operation of the floor sweeping robot 1, the first garbage baffle 12 will cover the dust collection port 113 under the action of the first return torsion spring 115, so as to prevent dust from escaping.

Further, a second fixed shaft, a second return torsion spring and a second garbage baffle 1002 are further mounted at the air inlet 1003; the second garbage baffle 1002 is movably mounted at the air inlet 1003 through the second fixed shaft; and, the second return torsion spring is sheathed on the second fixed shaft and enables the second garbage baffle 1002 to rotate relatively to open or close the air inlet 1003. Since the air extraction device for absorbing dust garbage is arranged inside the floor sweeping robot 1, the dust collection chamber 1001 can be maintained in a negative pressure state, and when the second garbage baffle 1002 is opened, the air path can be communicated. That is, an air flow enters the dust collection chamber 1001 through the air inlet 1003 and then arrives at the air outlet 1004 through the filter assembly to complete one circulation under the action of the fan, and garbage enters the dust collection chamber 100 from the air inlet 1003(1) along the air flow to be cleaned. When the floor sweeping robot 1 does not operate, the second garbage baffle 1002 will cover the air inlet 1003 under the action of the second return torsion spring, so as to prevent dust from escaping.

Further, an alarm (not shown) is further arranged in the dust collection device 2; a full garbage detection device (not shown) is arranged above the dust collection cavity 212; and, an output end of the full garbage detection device is electrically connected to an input end of the second control mainboard 215, and the output end of the second control mainboard 215 is connected to an input end of the alarm. In this specific embodiment, an alarm connected to the second control mainboard 215 is further arranged in the dust collection device 2, and a full garbage detection device is further arranged in the dust collection cavity 212. When the dust collection cavity 212 is fulfilled with garbage, the user can be prompted by the alarm, so that the user can know that the dust collection cavity 212 needs to be cleaned.

Further, the communication assembly further includes a fixed bracket 213 and a reset spring 232; the first conduit 25 is fixed on an inner bottom wall of the dust collection shell through the fixed bracket 213, and first fixed bumps 231 are arranged on two sides of the fixed bracket 213; second fixed bumps 221 are further arranged on outer sidewalls of two sides of the rubber suction port 22; and, one end of the reset spring 232 is sheathed on the first fixed bump 231, while the other end of the reset spring is sheathed on the second fixed bump 221 on the same side. The floor sweeping robot 1 will squeeze the rubber suction port 22 during its operation, and in order to avoid the deformation of the rubber suction port 22, the reset spring 232 is provided to reset the rubber suction port 22, thereby avoiding that the rubber suction port 22 cannot be restored due to a too large squeezing force.

Further, the rubber suction port 22 is of a funnel-shaped structure having an aperture that gradually decreases in a direction from being near the dust collection port 113 to being away from the dust collection port 113. The aperture of the rubber suction port 22 gradually decreases from the outside of the dust collection device 2 to the inside of the dust collection device, so that a buffer effect can be achieved when the rubber suction port 22 sucks garbage inside the water-dust integrated box 11.

Further, sound absorbing cotton 29 is fitted on inner walls of two sides of the dust collection shell. The sound absorbing cotton 29 can greatly reduce the noise generated during the operation of the dust collection device 2.

Figure 7:
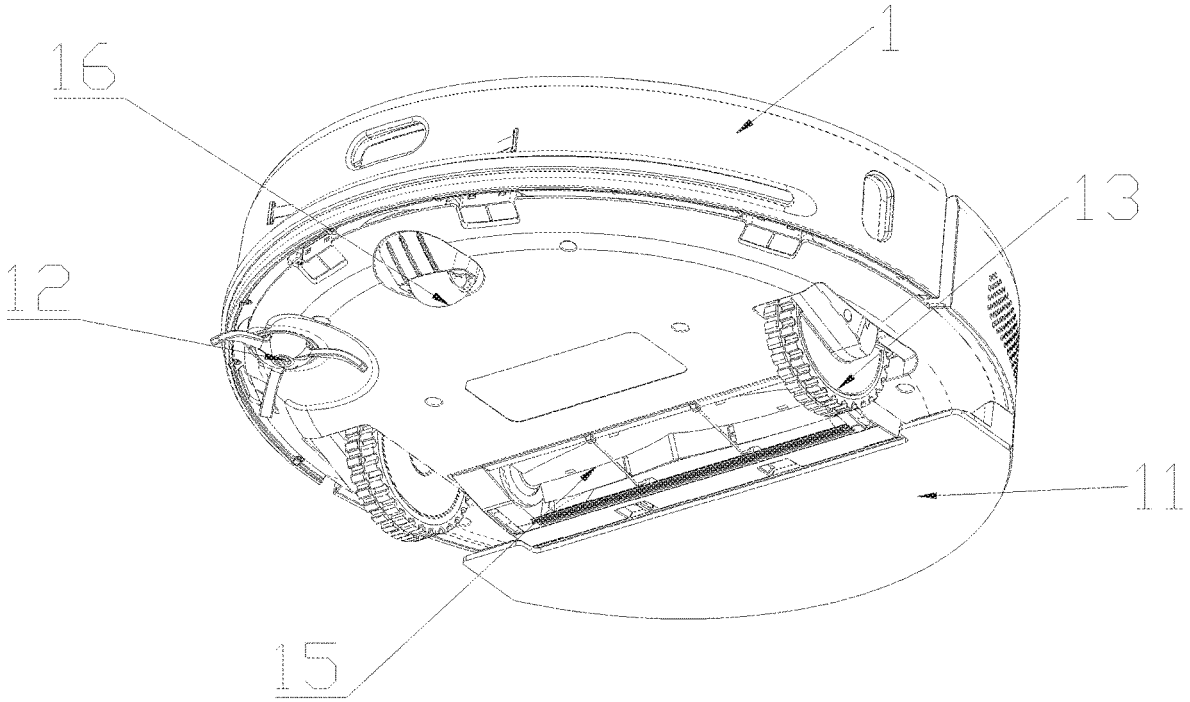
FIG. 7 is a schematic perspective view of the floor sweeping robot according to the present invention.
Figure 8:
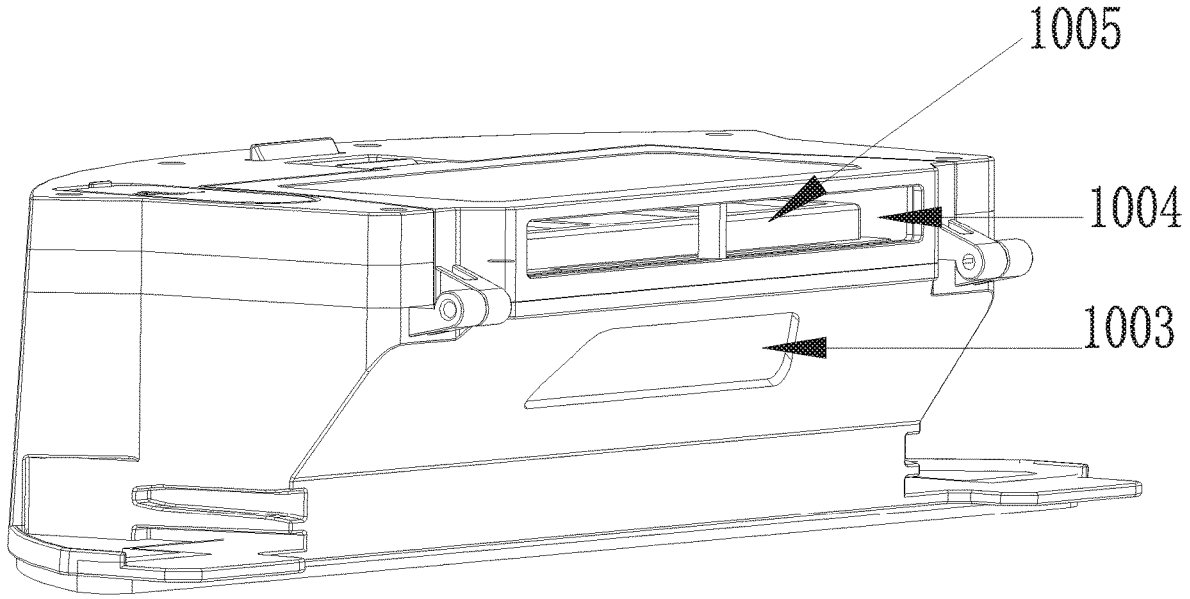
FIG. 8 is a schematic structural view of the water-dust integrated box according to the present invention.
Figure 9:
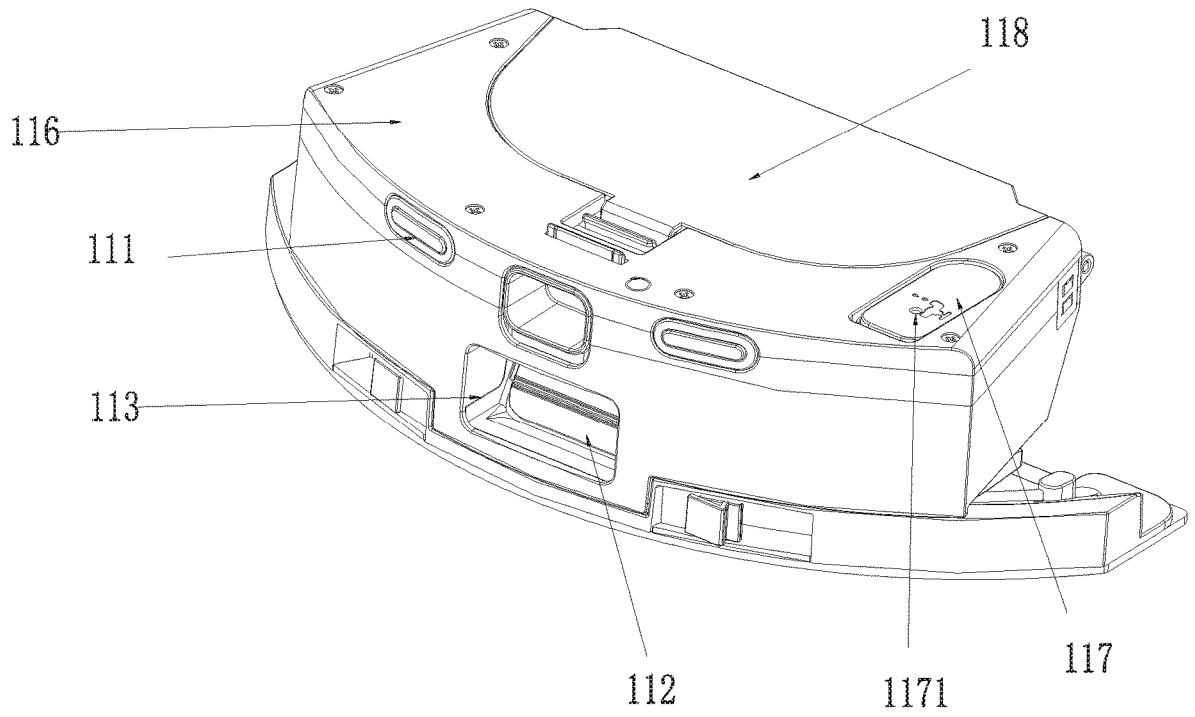
FIG. 9 is a schematic structural view of the water-dust integrated box according to the present invention, when viewed from another perspective.
Figure 10:
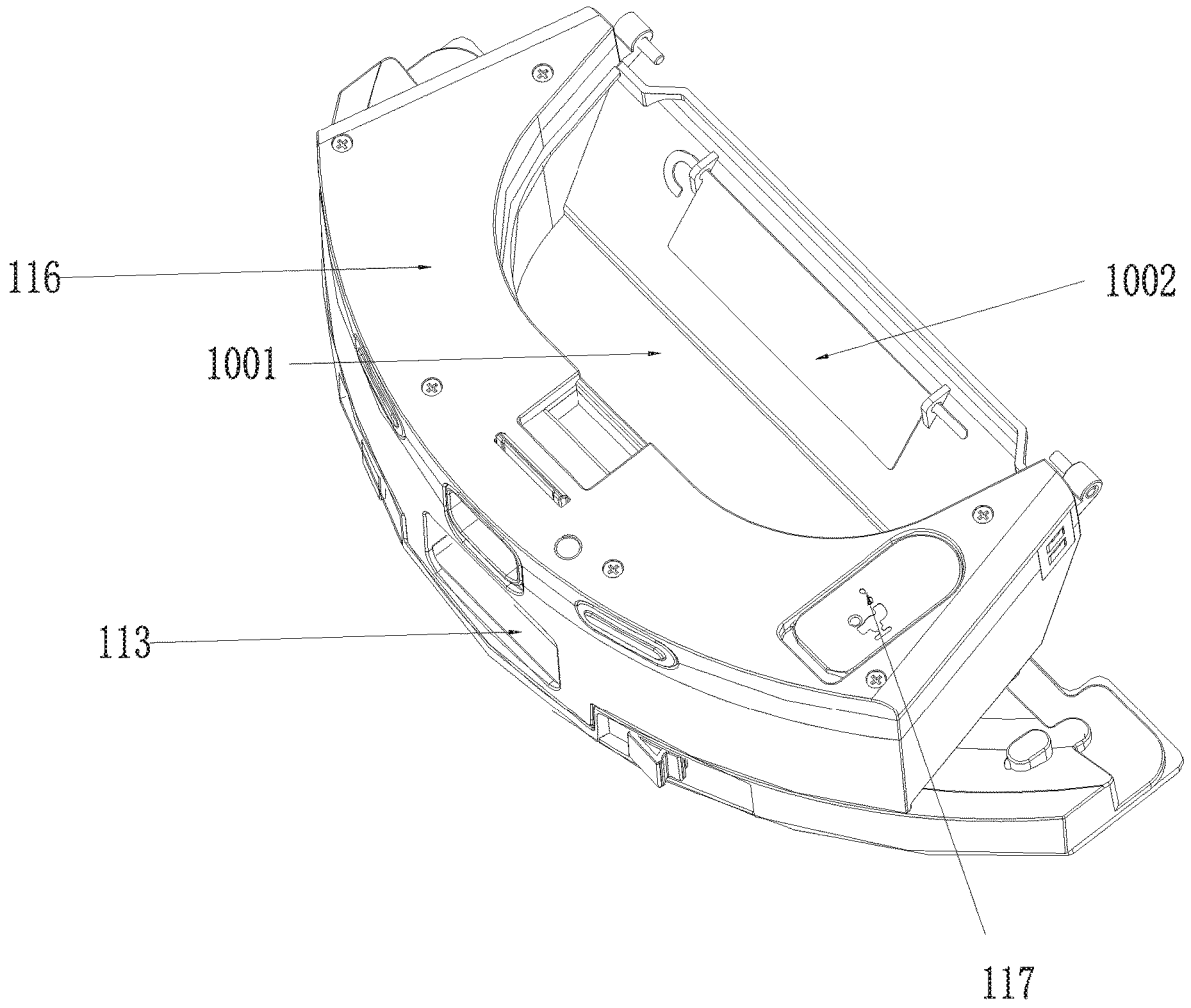
FIG. 10 is a schematic structural view of the interior of the water-dust integrated box according to the present invention.
Figure 11:
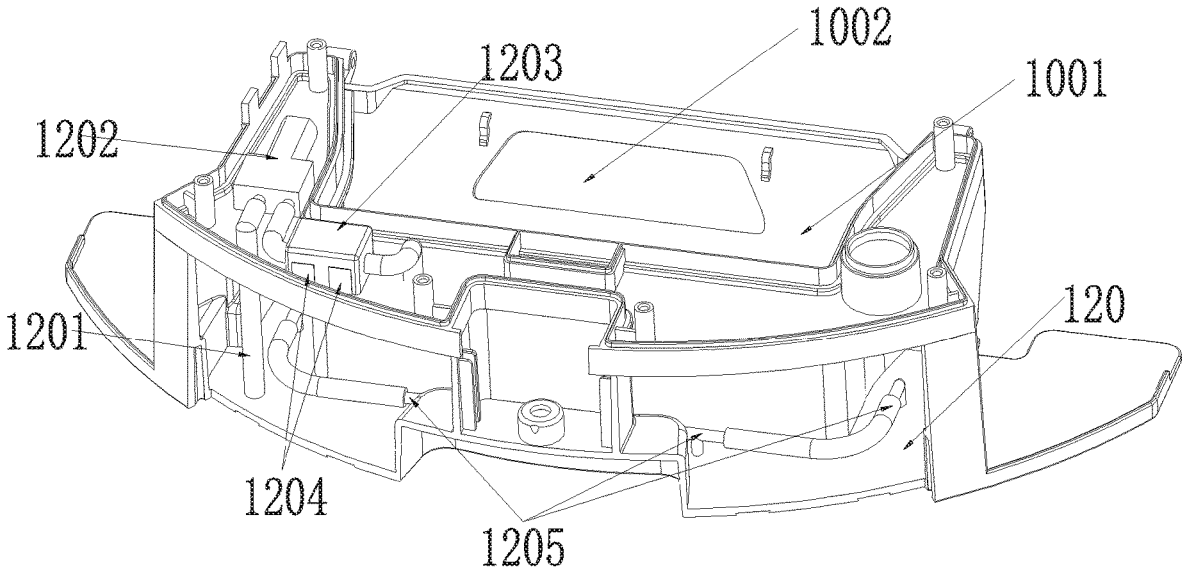
FIG. 11 is a schematic structural view of the interior of the water-dust integrated box according to the present invention, when viewed from another perspective.
Figure 12:
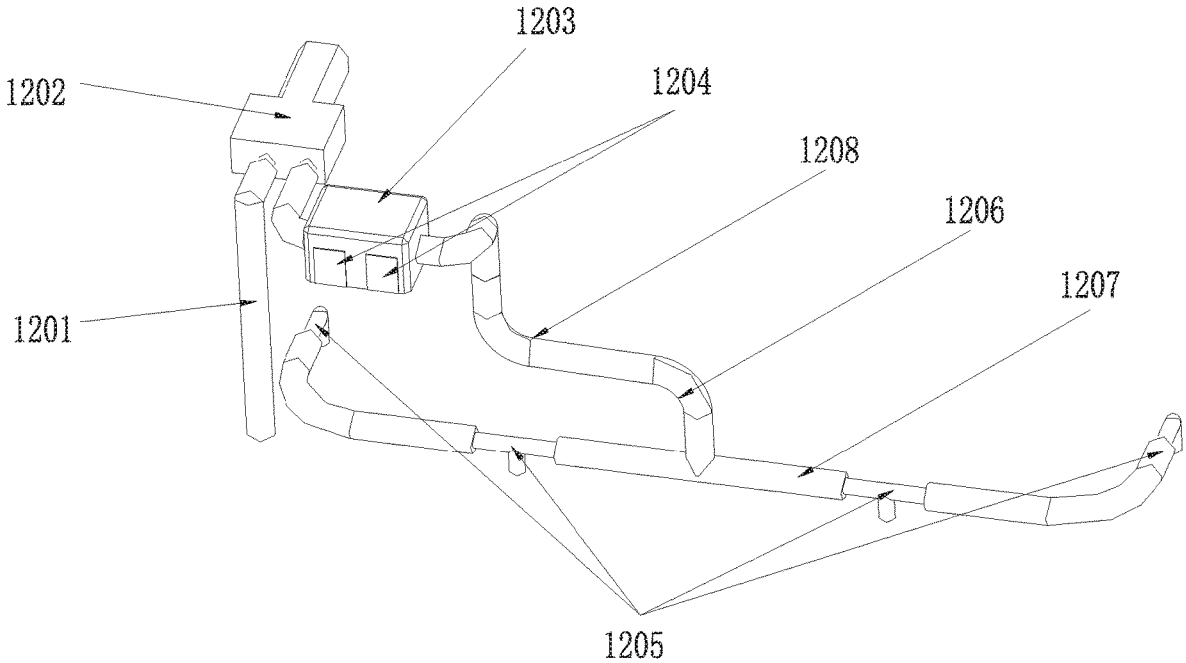
FIG. 12 is a schematic view of an operating principle of a water pump in a clean water chamber according to the present invention.

With reference to FIG. 7, further, a side electric hairbrush assembly 12, a driving wheel assembly 13, an intermediate sweeping assembly 15, a universal wheel 16 and an infrared detection assembly 14 are further arranged inside the floor sweeping robot 1. The electric hairbrush assembly is arranged on a side of the bottom edge of the floor sweeping robot 1. The driving wheel assembly 13 is arranged on the bottom of the floor sweeping robot 1 and drives the floor sweeping robot to move forward. The intermediate sweeping assembly 15 is arranged on the bottom of the floor sweeping robot 1, and sucks dust and conveys the dust to the water-dust integrated box 11. The universal wheel 16 is arranged on a side of the bottom of the floor sweeping robot 1. The infrared detection assembly 14 is arranged on the surface of the floor sweeping robot 1. The side electric hairbrush assembly 12, the driving wheel assembly 13, the intermediate sweeping assembly 15 and the infrared detection assembly 14 are all electrically connected to the first control mainboard.

The foregoing implementations are merely preferred implementations of the present invention and not intended to limit the scope of the present invention. Various variations and improvements made to the technical solutions of the present invention by a person of ordinary skill in the art without departing from the design spirit of the present invention shall fall into the protection scope defined by the appended claims of the present invention.

What is claimed is:

1. A floor sweeping robot system with an automatic dust collection function, comprising a dust collection device and a floor sweeping robot, wherein a first control mainboard and a water-dust integrated box are arranged in the floor sweeping robot; a dust collection chamber for collecting dust and a clean water chamber for storing clean water are arranged in the water-dust integrated box, and the dust collection chamber is independent of the clean water chamber; a dust collection port communicated with the dust collection chamber and a plurality of alignment elastic sheets electrically connected to the first control mainboard are arranged on a side face of the water-dust integrated box, and an air inlet communicated with the dust collection chamber is formed on an outer rear surface of the water-dust integrated box; an opening communicated with the dust collection chamber is formed at a top end of the water-dust integrated box, and a filter assembly is covered on the opening; an air outlet aligned with the filter assembly is formed on the outer rear surface of the water-dust integrated box; a water pump, a water suction pipe, a water outlet pipe, a one-way valve and a delivery pipe are arranged in the clean water chamber; two detection elastic sheets electrically connected to the first control mainboard are arranged on a surface of the one-way valve; a tail end of the water suction pipe is arranged on the bottom of the clean water chamber and communicated with an input end of the water pump, an output end of the water pump is communicated with an input end of the one-way valve, and an output end of the one-way valve is communicated with the water outlet pipe through the delivery pipe; and, the other end of the water outlet pipe extends outside the clean water chamber and is communicated with a floor mopping assembly located on the bottom of the water-dust integrated box; and the dust collection device comprises a dust collection shell, a garbage recycling assembly, a power supply assembly and a second control mainboard; the garbage recycling assembly, the power supply assembly and the second control mainboard are all arranged in the dust collection shell; trigger elastic sheets that are electrically connected to the second control mainboard and provided in a number corresponding to the number of the alignment elastic sheets are arranged on a surface of the dust collection shell; a dust collection cavity for accommodating dust garbage is further arranged in the dust collection shell; the garbage recycling assembly comprises a negative pressure device that is communicated with the dust collection cavity and generates a negative pressure within the dust collection cavity, and a communication assembly that is communicated with the dust collection cavity; the power supply assembly is electrically connected to the negative pressure device and the second control mainboard, respectively, and the second control mainboard is electrically connected to the negative pressure device; the communication assembly comprises a first conduit, a silicone passage, a second conduit and a rubber suction port that are communicated successively; the first conduit is communicated with the dust collection cavity, the rubber suction port extends outside the dust collection device, and the silicone passage can be compressively deformed in its axial direction; and, the trigger elastic sheets come into contact with the corresponding alignment elastic sheets of the floor sweeping robot, and the rubber suction port of the dust collection device is fitted at the dust collection port of the floor sweeping robot wherein the power supply module comprises a power supply control board, an adapter and a wireless communication module; an output end of the adapter is connected to an input end of the power supply control board; an output end of the power supply control board is connected to the second control mainboard and an input end of the negative pressure device, respectively; and, the wireless communication module is in bidirectional communication connection with the second control mainboard.

2. The floor sweeping robot system with an automatic dust collection function according to claim 1, wherein the water outlet pipe is of a T-shaped structure; the water output pipe comprises a vertical pipe in a vertical direction and a horizontal pipe in a horizontal direction; one end of the vertical pipe is communicated with the delivery pipe, while the other end of the vertical pipe is communicated with the horizontal pipe; and, a plurality of water outlet nozzles extending outside the clean water chamber are arranged on the bottom of the horizontal pipe.

3. The floor sweeping robot system with an automatic dust collection function according to claim 1, wherein a water feeding hole communicated with the clean water chamber is formed at an upper end of the water-dust integrated box, a seal cover is mounted at the water feeding hole, and a ventilation slot is arranged on the seal cover.

4. The floor sweeping robot system with an automatic dust collection function according to claim 1, wherein the negative pressure device comprises an air extraction fan communicated with the dust collection cavity; an output end of the second control mainboard is connected to an input end of the air extraction fan; an air inlet end of the air extraction fan is located on the bottom of the dust collection cavity and communicated with the dust collection cavity; and, a filter screen is arranged at the air inlet end of the air extraction fan.

5. The floor sweeping robot system with an automatic dust collection function according to claim 1, wherein the floor sweeping robot further comprises a first fixed shaft, a first return torsion spring and a first garbage baffle; the first garbage baffle is movably mounted at the dust collection port of the water-dust integrated box through the first fixed shaft; and, the first return torsion spring is sheathed on the first fixed shaft and enables the first garbage baffle to rotate relatively to open or close the dust collection port.

6. The floor sweeping robot system with an automatic dust collection function according to claim 1, wherein a second fixed shaft, a second return torsion spring and a second garbage baffle are further mounted at the air inlet; the second garbage baffle is movably mounted at the air inlet through the second fixed shaft; and, the second return torsion spring is sheathed on the second fixed shaft and enables the second garbage baffle to rotate relatively to open or close the air inlet.

7. The floor sweeping robot system with an automatic dust collection function according to claim 1, wherein an alarm is further arranged in the dust collection shell; a full garbage detection device is arranged above the dust collection cavity; and, an output end of the full garbage detection device is electrically connected to the input end of the second control mainboard, and the output end of the second control mainboard is connected to an input end of the alarm.

8. The floor sweeping robot system with an automatic dust collection function according to claim 1, wherein the communication assembly further comprises a fixed bracket and a reset spring; the first conduit is fixed on an inner bottom wall of the dust collection shell through the fixed bracket, and first fixed bumps are arranged on two sides of the fixed bracket; second fixed bumps are further arranged on outer sidewalls of two sides of the rubber suction port; and, one end of the reset spring is sheathed on the first fixed bump, while the other end of the reset spring is sheathed on the second fixed bump on the same side.

9. The floor sweeping robot system with an automatic dust collection function according to claim 1, wherein the rubber suction port is of a funnel-shaped structure having an aperture that gradually decreases in a direction away from the dust collection port.

* * * * *